US008632415B1

(12) United States Patent
Smith

(10) Patent No.: US 8,632,415 B1
(45) Date of Patent: Jan. 21, 2014

(54) PUTTER

(76) Inventor: John T. Smith, Harmon, IL (US)

( * ) Notice: Subject to any disclaimer, the term of this patent is extended or adjusted under 35 U.S.C. 154(b) by 343 days.

(21) Appl. No.: 13/191,179

(22) Filed: Jul. 26, 2011

Related U.S. Application Data

(60) Provisional application No. 61/367,592, filed on Jul. 26, 2010.

(51) Int. Cl.
*A63B 53/04* (2006.01)
*A63B 47/02* (2006.01)

(52) U.S. Cl.
USPC ..... 473/286; 473/340

(58) Field of Classification Search
USPC ..... 473/286, 340, 282, 350
See application file for complete search history.

(56) References Cited

U.S. PATENT DOCUMENTS

| | | | | | |
|---|---|---|---|---|---|
| 1,960,110 | A * | 5/1934 | Iles | 473/286 |
| 3,300,241 | A * | 1/1967 | Eberwein et al. | 294/19.2 |
| 3,374,027 | A * | 3/1968 | Jacobs | 294/19.2 |
| 3,632,112 | A * | 1/1972 | Jacobs | 473/286 |
| 3,708,172 | A * | 1/1973 | Rango | 473/249 |
| 4,976,436 | A * | 12/1990 | Serizawa | 473/286 |
| 5,368,302 | A * | 11/1994 | Thomas | 473/286 |
| D364,666 | S * | 11/1995 | Nagy | D21/743 |
| 5,485,999 | A * | 1/1996 | Hull et al. | 473/286 |
| 5,509,658 | A | 4/1996 | Youngblood | |
| 6,692,372 | B1 | 2/2004 | Colucci | |
| 6,702,688 | B2 * | 3/2004 | Hale | 473/226 |
| 6,863,617 | B2 * | 3/2005 | Park | 473/226 |
| 6,878,072 | B1 * | 4/2005 | Henry | 473/286 |
| D521,089 | S | 5/2006 | Dingman | |
| 7,086,959 | B2 * | 8/2006 | D'Agguano | 473/282 |
| 7,223,178 | B2 * | 5/2007 | Henry | 473/252 |
| 7,458,899 | B2 * | 12/2008 | Michaud | 473/226 |
| 7,559,848 | B2 * | 7/2009 | Nickel | 473/286 |
| 7,846,036 | B2 * | 12/2010 | Tanaka | 473/286 |
| 2002/0022539 | A1 | 2/2002 | Smith et al. | |
| 2004/0147334 | A1 * | 7/2004 | D'Agguano | 473/286 |
| 2004/0242344 | A1 * | 12/2004 | Williams et al. | 473/340 |
| 2005/0197205 | A1 * | 9/2005 | Hale, Jr. | 473/340 |
| 2006/0063607 | A1 * | 3/2006 | Crossley | 473/340 |
| 2007/0155535 | A1 * | 7/2007 | Bunker | 473/340 |
| 2008/0248894 | A1 * | 10/2008 | Henry | 473/340 |
| 2008/0305881 | A1 | 12/2008 | Paul et al. | |
| 2009/0170629 | A1 * | 7/2009 | Hilton | 473/334 |
| 2010/0009781 | A1 * | 1/2010 | Vanderbilt et al. | 473/409 |
| 2010/0227704 | A1 * | 9/2010 | Souza et al. | 473/340 |
| 2010/0323807 | A1 * | 12/2010 | Rha | 473/252 |
| 2012/0064988 | A1 * | 3/2012 | Raab | 473/286 |

* cited by examiner

*Primary Examiner* — Raleigh W Chiu
(74) *Attorney, Agent, or Firm* — Hamilton IP Law, PC; Jay R. Hamilton; Charles A. Damschen

(57) ABSTRACT

In one embodiment of a putter the putter comprises a head, a cap, at least one brush insert, and a handle. The brush insert(s) may be positioned between the head and cap and retained by the engagement of the cap with the head. The head and cap may be formed with respective ball apertures such that a golf ball may pass through those apertures. The brush insert, which is replaceable, may be formed with a plurality of radially oriented brushes having distal ends extending inward. The putter may be used to retrieve a golf ball from a golf cup by lowering the putter into the cup and forcing the golf ball into the brush insert. Subsequently removing the golf ball coupled with inserting the golf ball into the brush insert cleans the golf ball.

17 Claims, 5 Drawing Sheets

PUTTER

CROSS REFERENCE TO RELATED APPLICATIONS

Applicant claims priority from provisional U.S. Pat. App. No. 61/367,592 filed on Jul. 26, 2010, which is incorporated by reference herein in its entirety.

FIELD OF INVENTION

The present invention relates to a putter, and more specifically, to a putter for lifting a golf ball from a golf cup and simultaneously cleaning a golf ball.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

BACKGROUND

Many accessories and convenience items have been developed for the sport of golfing. One area that has received a great deal of attention is ball retrieval devices. These devices come in a wide variety of styles but may be generally defined by the particular environment in which they operate.

Some ball retrieval devices are specifically designed to retrieve golf balls from water hazards. The basic components of such devices generally include a telescoping type handle that enables the user to reach out far enough into the water hazard to retrieve the ball and an open net or cage-like device at one end of the handle which allows for drainage during the retrieval process.

A second type of ball retrieval device is specifically designed to accumulate a number of golf balls at one time. Such devices can be in the form of automatic sweepers that roll over the balls and sweep them up off the ground and into a bin.

A third type of device is specifically designed to pick the golf ball up off of the ground or from within the putting green golf cup. One type of device for accomplishing this function is a movable claw-type grabbing device that is attached to a pole. Generally, a trigger mechanism on the pole handle enables the user to open and close the claw in order to pick up the ball.

Many of the devices are manufactured to stand alone and therefore must be purchased as an addition to one's golf clubs. Such an approach in not only more expensive, but also requires the golfer to carry an additional device in his golf bag.

Some attempts have been made at designing items that incorporate several features into one object. For example, U.S. Pat. No. 5,509,658 discloses a putter with a golf ball pick-up structure in the center thereof. However, this design does not provide any structure for cleaning the golf ball during retrieval.

BRIEF DESCRIPTION OF THE FIGURES

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limited of its scope, the invention will be described and explained with additional specificity and detail through the use of the accompanying drawings.

DETAILED DESCRIPTION

Listing of Elements

Figure 1:
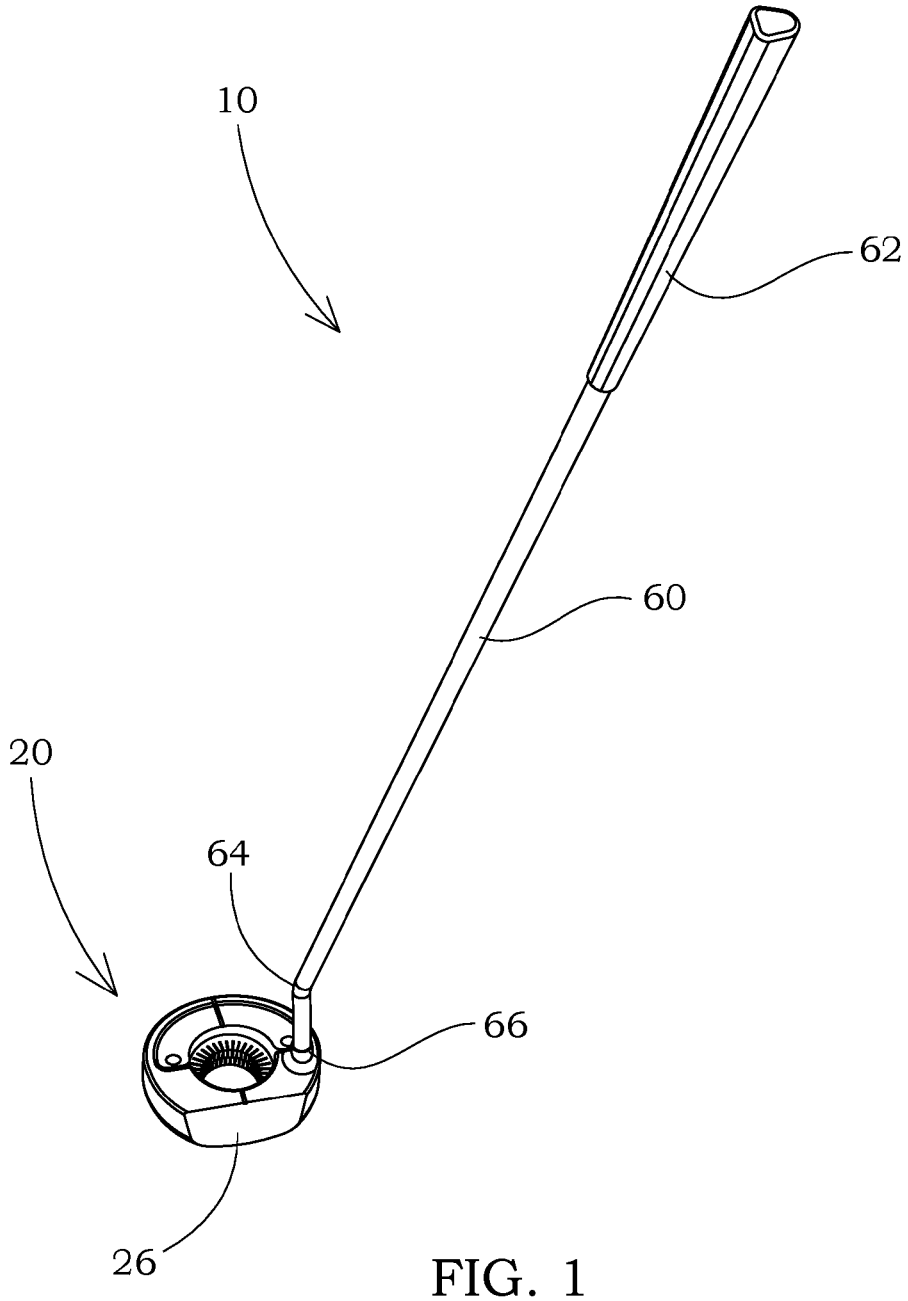
FIG. 1 provides a perspective view of a first embodiment of the putter fully assembled.

| ELEMENT DESCRIPTION | ELEMENT # |
|---|---|
| Putter | 10 |
| Ball | 12 |
| Fastener | 14 |
| Alignment pin | 16 |
| Head | 20 |
| Connector port | 21 |
| Alignment port | 21a |
| Head ball aperture | 22 |
| Handle housing | 23 |
| Handle aperture | 23a |
| Head recess | 24 |
| Strike face | 26 |
| Head bottom contour | 27 |
| Interface ring | 28 |
| Interface ring ridge | 28a |
| Cavity | 29 |
| Cap | 30 |
| Connector receiver | 31 |
| Cap alignment port | 31a |
| Cap ball aperture | 32 |
| Cap wall | 34 |
| Cap bottom contour | 37 |
| Insert retainer lip | 38 |
| Insert retainer ridge | 38a |
| Brush insert | 40 |
| Brush | 42 |
| Outer ring | 44 |
| Semi-rigid insert | 46 |
| Semi-rigid spacer | 48 |
| Retainer | 50 |
| Spacer | 52 |
| Handle | 60 |
| Grip | 62 |
| Angle | 64 |
| Head engagement portion | 66 |

DETAILED DESCRIPTION

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

Referring now to the drawings, wherein like reference numerals designate identical or corresponding parts throughout the several views, FIG. 1 provides a perspective view of a first embodiment of a putter 10. The putter 10 generally includes a handle 60 connected to a head 20. The handle 60 may be fashioned with a grip 62 at one end and an angle 64 near the end of the handle 60 opposite the grip 62. The major length of the handle 60 is substantially linear. The grip 62 may be affixed to the handle 60 using any method and/or structure suitable for securing a grip 62. The grip 62 may be constructed of rubber, leather, synthetic materials, or combinations thereof.

Figure 2A:
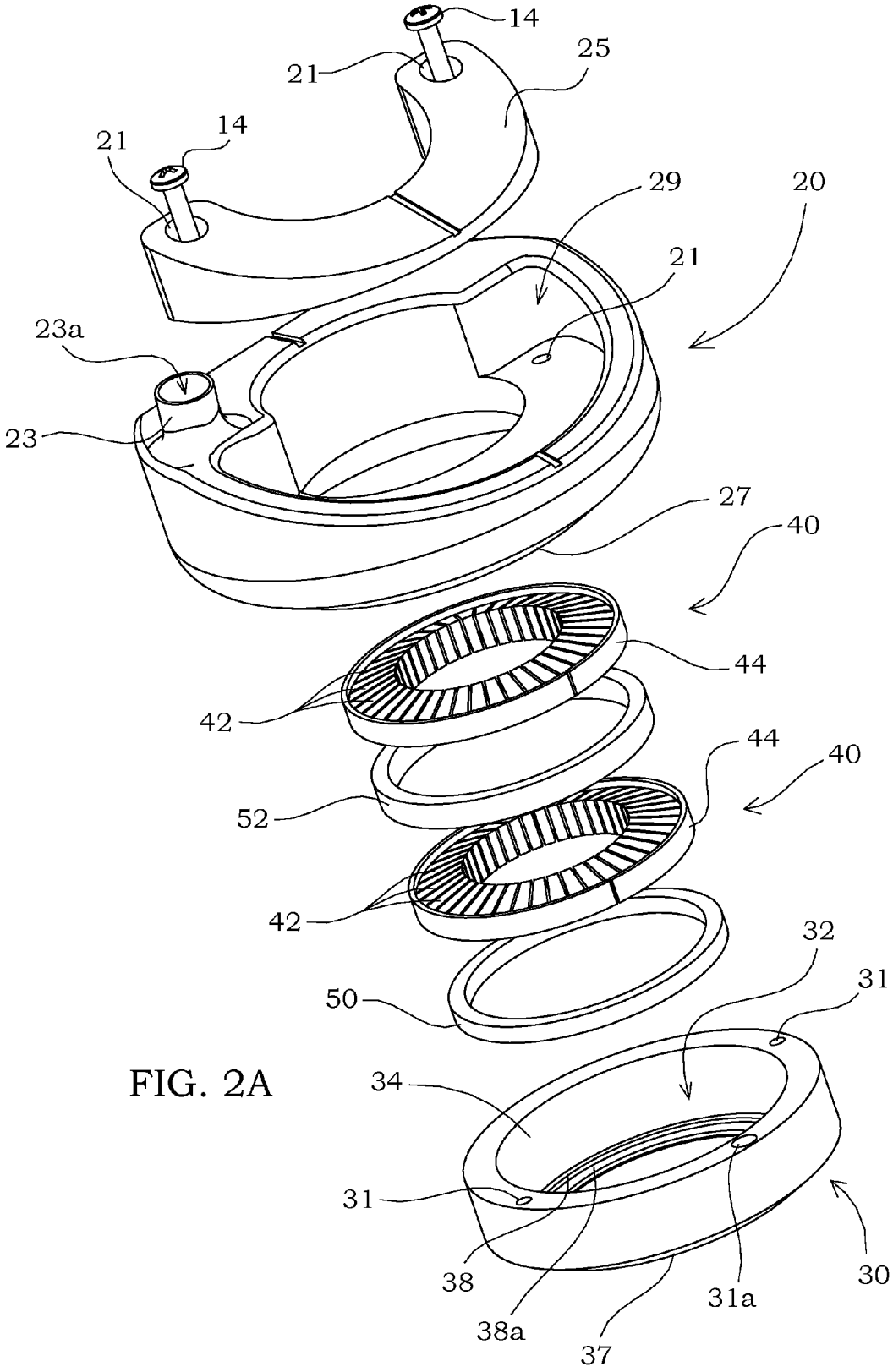
FIG. 2A provides an exploded view of the first embodiment of the putter with the handle removed for clarity.

An exploded view of a first embodiment of a head 20 and various elements adjacent thereto is shown in FIG. 2A. The first embodiment includes a head ball aperture 22 generally formed in the center of the head 20. A head recess 24 may surround the head ball aperture in the top surface of the head 20. The recess may aide the user in retrieving a ball 12 from the head 20 after the user has used the putter to pick up the ball 12, which operation is described in detail below. A plug 25 may be positioned within a portion of the head recess 24 for aesthetic reasons. In such an embodiment, the plug 25 may be formed with at least one connector port 21 therein so that the plug 25 may be secured to the head 20 and not detract from the functionality of the putter 10 during use.

Figure 3:
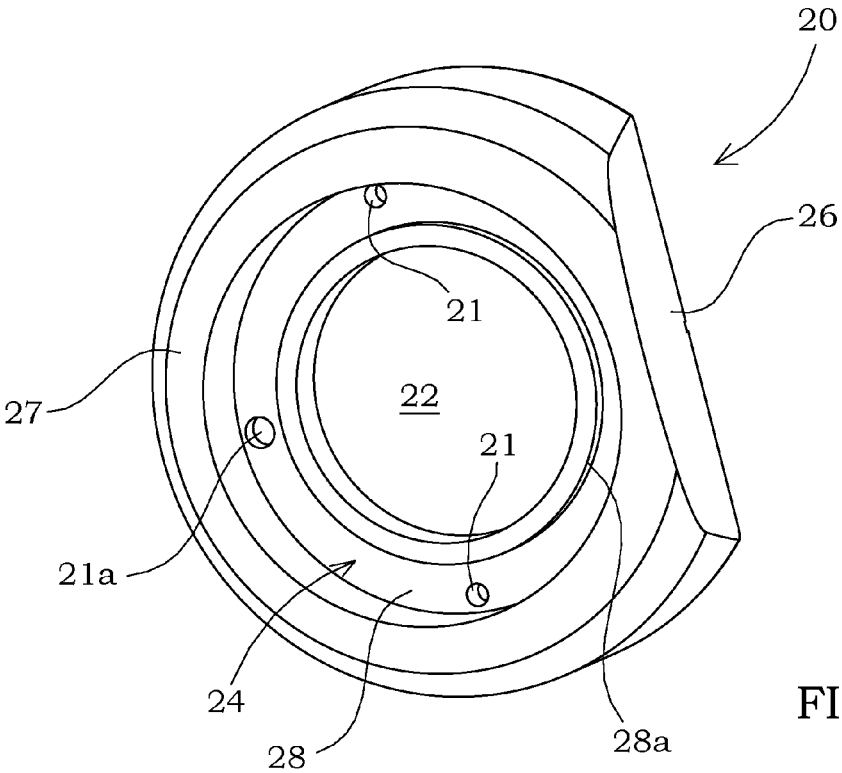
FIG. 3 provides a detailed perspective view of the head from the first embodiment of the putter.
Figure 3A:
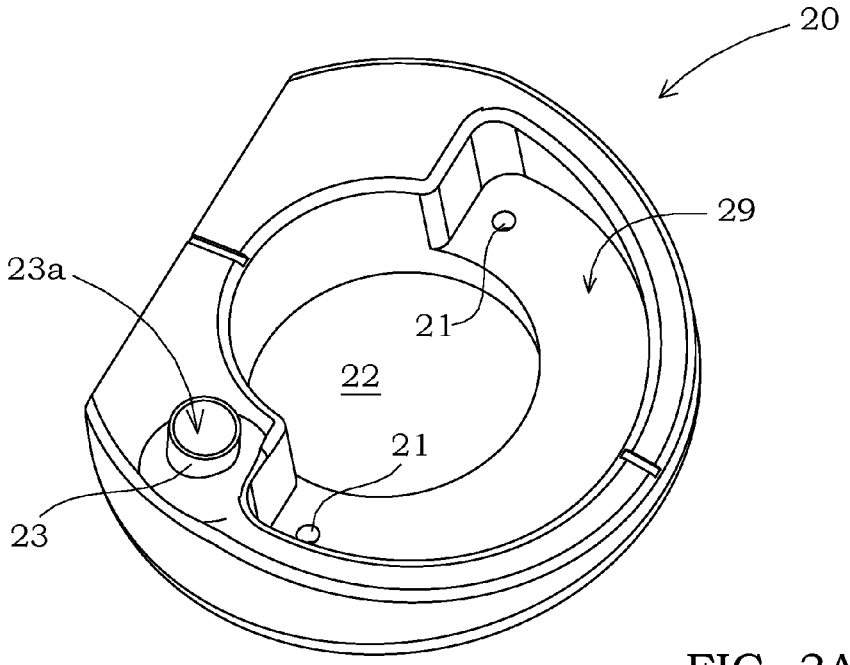
Figure 4:
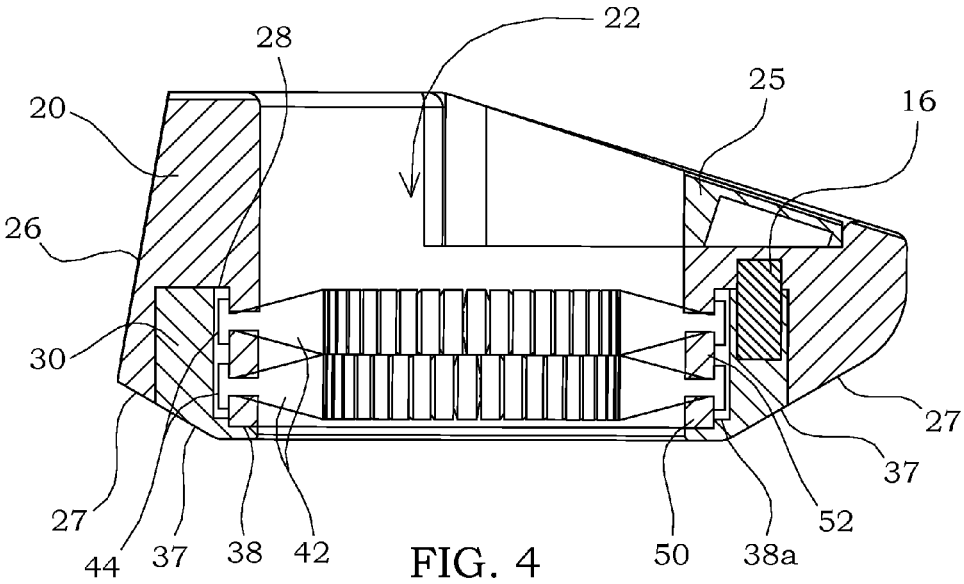
FIG. 4 provides a cross-sectional view of the first embodiment of the putter.
Figure 5:
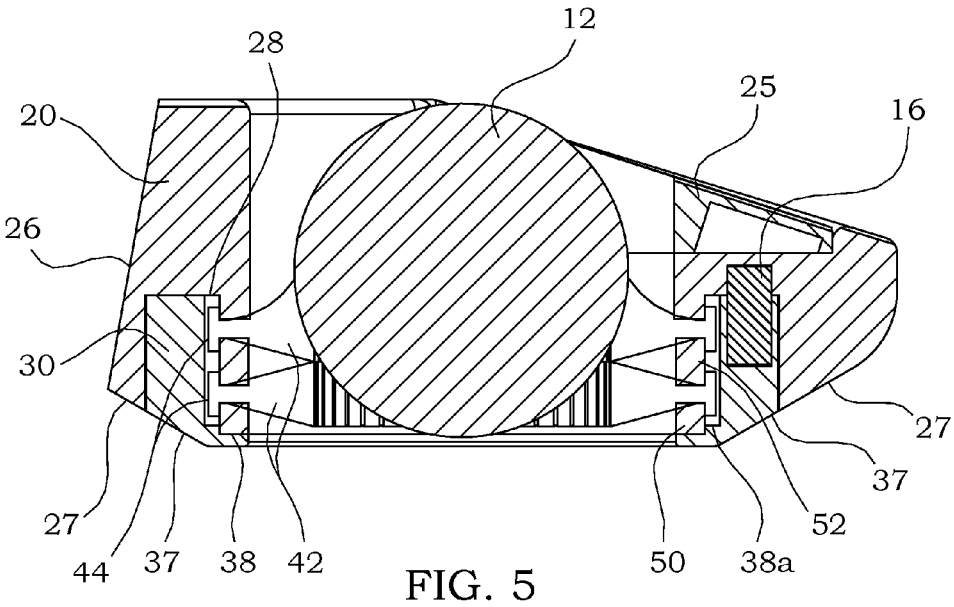
FIG. 5 provides a cross-sectional view of the first embodiment of the putter with a golf ball engaged therewith.

A handle housing 23 may be integrally formed with the head 20, as may a laser housing (not shown). The handle housing 23 includes a handle aperture 23*a*, which provides an interface between the head 20 and the handle 60 at the head engagement portion 66 of the handle 60, as shown in FIG. 3. Laser ports (not shown) may be positioned on either side of the strike face 26 on the head 20. It is contemplated that laser ports may be positioned so that they are far enough apart from one another that a ball 12 will fit between them. The electronics and/or optics required to create the laser beams may be stored in the laser housing. Such electronics and/or optics are not shown herein for purposes of clarity, but may be any type known to those skilled in the art that is suitable for use with the putter 10. The strike face 26 is typically formed from a metal or metal alloy and is configured to contact the ball 12 during use. The brush 26 may be formed from other materials depending on the specific embodiment of the putter 10. Additionally, the laser ports may be positioned in the strike face 26 in certain embodiments of the putter 10.

A detailed view of the bottom surface of one embodiment of a head 20 for use with the putter 10 is shown in FIG. 3. A cavity 29 may be formed in the bottom surface of the head 20 into which a cap 30 (described in detail below) may be received. An interface ring 28 may be formed in the head 20 around the periphery of the head ball aperture 22. The bottom surface of the interface ring 28 may include an interface ring ridge 28*a*, which is described in detail below. The bottom surface of the head 20 may be formed with a head contour 27, which may be configured to mimic the concave curvature of a golf cup (not shown).

Figure 2B:
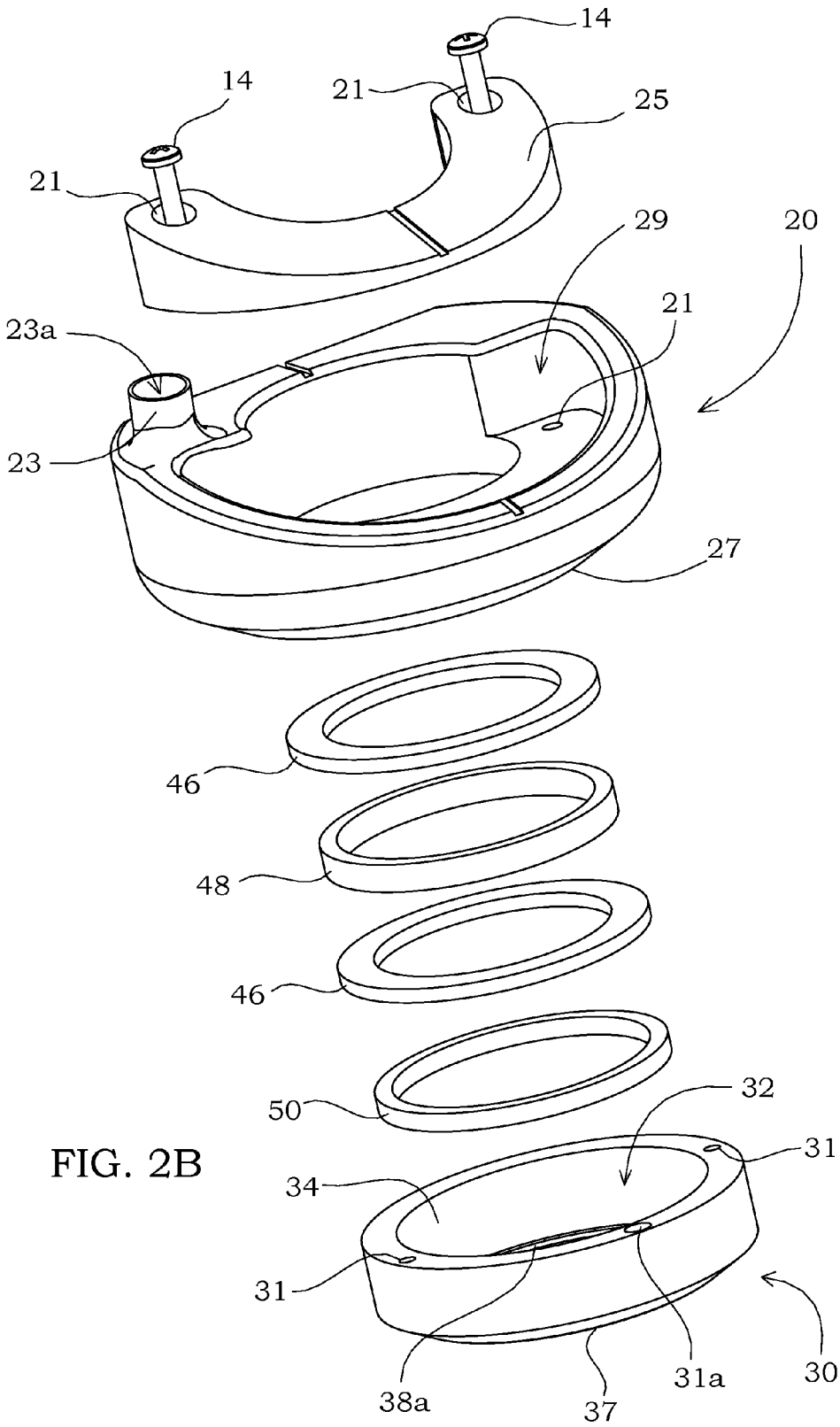
FIG. 2B provides an exploded view of a second embodiment of the putter with the handle removed for clarity.

As shown in FIGS. 2A & 2B, a cap 30 may be configured to engage the head 20 about the cavity 29. The cap 30 is formed with a cap ball aperture 32 passing through the center thereof, which is generally concentric with the head ball aperture 22. The cap 30 may also include an insert retainer lip 38 around the periphery of the cap ball aperture 32 and an annular cap wall 34 extending axially upward with respect to the cap ball aperture 32. An insert retainer ridge 38*a* may be formed in the insert retainer lip 38.

At least one brush insert 40 may be placed within the cap 30 so that the outer axial surface of the brush insert 40 is adjacent the inner axial surface of the cap 30. Accordingly, the brush insert 40 may be sandwiched between the head 20 and the cap 30. The first embodiment includes two brush inserts 40 so positioned. A retainer 50 may be placed between the brush insert 40 and the insert retainer lip 38 formed in the cap 30, as shown best in FIG. 3. The retainer 50 may be sized so that upon retrieval, the ball 12 is positioned closer to the top side of the head 20 than it is to the bottom side thereof. A spacer 52 may be positioned between each brush insert 40 as needed for proper ball 12 placement upon retrieval. In other embodiments of the putter 10 not show herein, the cap 30 is not formed with a cap wall 34, and the outer axial surface of the brush insert 40 is adjacent the inner axial surface of the cavity 29 formed in the head 20.

Each brush ring 40 may be comprised of an outer ring 44 from which a plurality of brushes 42 protrude. The brushes 42 are generally radially oriented and protrude radially inward from the outer ring 44 such that the distal ends of the brushes 42 form a circle having a diameter slightly less than that of a ball 12. The outer ring 44 may be constructed of a polymer, metal, metallic alloy, cellulosic material, combination thereof, or any other suitable material for retrieving a ball 12. The brushes 42 may be retained in the outer ring 44 though friction, by using a chemical adhesive, or any other structure and/or method suitable for securing the brushes 42 to the outer ring 44. The brushes 42 may be constructed of a polymer, metal, metallic alloy, cellulosic material, combination thereof, or any other suitable material.

When the putter 10 is assembled, the brush insert(s) 40 are typically positioned between the bottom surface of the interface ring 28 in the head 20 and the top surface of the insert retainer lip 38 in the cap 30. An interface ring ridge 28*a* may be formed in the interface ring 28 to securely locate the brush insert 40 adjacent the head 20 and to provide additional clearance between the brush insert 40 and the head ball aperture 22. Similarly, the insert retainer ridge 38*a* may serve to securely locate the brush insert 40 adjacent the cap 30 and may provide additional clearance between the brush insert 40 and the cap ball aperture 32.

The head 20 and the cap 30 may be secured to one another by any method and/or structure suitable for a putter 10. However, in the embodiments pictured herein, two fasteners 14 (configured as bolts in the pictured embodiments) are positioned in the connector apertures connector ports 21 in the head 20 and plug 25 so as to engage corresponding connector receivers 31 formed in the cap 30. To ensure that the cap 30 and head 20 are properly aligned, the head may be formed with an alignment port 21*a*, and the cap 30 may be formed with a cap alignment port 31*a*. One end of an alignment pin 16 may be inserted in the alignment port 21*a* in the head 20 and the opposite end of the alignment pin 16 may be inserted in the cap alignment port 31*a* to ensure the cap 30 is properly positioned with respect to the head 20.

In the embodiments of the putter 10 pictured herein, the brush inserts 40 may be easily replaced. A user may simply remove the fasteners 14 and slide the cap 30 away from the head 20, thereby exposing the brush inserts 40. It is contemplated that this design will allow the user, to a certain extent, to customize the axial position along the head ball aperture 22 at which a ball 12 comes to rest during retrieval. This may be done using retainers 50 and/or spacers 52.

The distal ends of the brush 42 will protrude into the head ball aperture 22 and cap ball aperture 32 such that the inner diameter of the brush insert 40 is slightly less than that of a ball 12. The tensile strength, length, and the rigidity of the brushes 42 may be adjusted along with the inner diameter of the circle formed by the distal ends of the brushes 42 so that a ball 12 positioned within the inner diameter of the brush insert 40 will be retained therein unless acted upon by an outside force greater than normal gravitational force. Accordingly, in most embodiments of the putter 10 the brushes 42 will be at least somewhat flexible to allow positioning of a ball 12 within the inner diameter of the brush insert 40 and also facilitate removal therefrom. Furthermore, the configuration of the brushes 42 may further be designed to facilitate cleaning of the ball 12 during retrieval of the ball 12 from a cup and subsequent removal of the ball 12 from the putter 10.

A second embodiment of the putter 10 is shown in FIG. 2B. In the second embodiment of the putter 10, instead of brush inserts 40 positioned in the head 20, semi-rigid inserts 46 may be secured between the head 20 and the cap 30. The other components of the putter 10 may be configured in substantially the same manner as shown in FIG. 2A for the first embodiment. Accordingly, brush inserts 40 and semi-rigid inserts 46 may be interchangeable within a single putter 10.

At least one semi-rigid insert 46 may be placed within the cap 30 so that the outer axial surface of the semi-rigid insert 46 is adjacent the inner axial surface of the cap 30. Accordingly, the semi-rigid insert 46 may be sandwiched between the head 20 and the cap 30. The second embodiment of the putter 10 includes two semi-rigid inserts 46 so positioned. A retainer 50 may be placed between one semi-rigid insert 46 and the insert retainer lip 38 formed in the cap 30, as shown best in FIG. 2B. The retainer 50 may be sized so that upon retrieval, the ball 12 is positioned closer to the top side of the head 20 than it is to the bottom side thereof. A semi-rigid spacer 48 may be positioned between each semi-rigid insert 46 as needed for proper ball 12 placement upon retrieval.

The semi-rigid inserts 46 may be comprised of a material rigid enough to allow the putter 10 to qualify as a USGA approved putter 10. Such material may include but is not limited to phenolic-based polymers, plastics, natural rubber, other polymers, other synthetic materials, and/or combinations thereof. The material for the semi-rigid inserts 46 may be chosen such that the putter 10 is still able to simultaneously allow the user to pick up and clean a ball 12, as previously described for a putter 10 using brush inserts 40. However, in an embodiment using semi-rigid inserts 46, the inner diameter of the semi-rigid inserts 46 may be different than that of the brush inserts 40. Furthermore, because of the difference in material properties, the semi-rigid inserts 46 may act on the ball 12 in more of a wiping or scraping manner than do the brush inserts 40 to both retrieve and clean the ball 12.

In one embodiment of the putter 10, the material used to construct the semi-rigid inserts 46 is a weather- and chemical-resistant santoprene rubber having a thickness of approximately 3/32 of an inch. Such a material is abrasion resistant and impact resistant. This material has a useable temperature range of −50 to 275 degrees F. The durometer rating of this material is 55A. Applicant has found that using this material in the putter 10 results in a product that the USGA will approve for use. It is contemplated that for a standard golf ball 12, the inner diameter of the semi-rigid inserts 46 will be approximately 1.67 inches, and the outer diameter will be approximately 2.18 inches. These dimensions, when employed with the santoprene rubber described above, result in a putter 10 that is capable of simultaneously picking up a standard golf ball 12 from a golf cup and cleaning and/or wiping the ball 12, which putter 10 is approved for use by the USGA.

It is contemplated that the putter 10 may be packaged as a kit including at least one brush insert 40 and at least one semi-rigid insert 46. In this manner, the user may employ the brush inserts 40 during recreational play, and then switch to the semi-rigid inserts 46 for tournaments or other competitive play.

The optimal dimensions of the head 20, handle housing 23, head recess 24, laser housing (not shown), strike face 26, interface ring 28, interface ring ridge 28*a*, cavity 29, cap 30, cap wall 34, insert retainer lip 38, and insert retainer ridge 38*a* will vary from one embodiment of the putter 10 to the next, and are therefore in no way limiting to the scope of the putter 10. Other dimensions of the various elements of the putter 10 will vary from one embodiment to the next depending on such factors including but not limited to height of the user, preferences of the user, and frequency of use.

In operation, the user may employ the laser ports to provide a direct line from the ball 12 to the golf cup in order to properly align the put. After the user has made the putt, the user may simply lower the head 20 of the putter 10 into the golf cup and press it down over the ball 12, thereby forcing the ball 12 into the inner diameter of the brush insert(s) 40. The user may then lift the head 20 and ball 12 from the golf cup using the handle 60, thereby retrieving the ball 12 from the golf cup without physically reaching into the golf cup.

The optional head bottom contour 27 and cap bottom contour 37 may facilitate properly aligning the ball 12 during retrieval of the ball 12. The user may then remove the ball 12 from the head 20 by pushing the ball 12 down through the brush insert(s) 40 and cap ball aperture 32 or by pushing the ball 12 up through the brush insert(s) 40 and head ball aperture 22. Accordingly, each time the putter 10 is used to retrieve a ball 12 from a golf cup, the ball 12 is in moving contact with the brushes 42 twice (once during insertion and once during removal), thereby cleaning the ball 12.

The various elements of the head 20 may be integrally formed with one another or they may be separately formed and later affixed to one another, as may the various elements of the cap 30. The various elements of the putter 10 may be formed of any material known to those of ordinary skill in the art that is suitable for the application for which the putter 10 is designed. Such materials include but are not limited to rubber, silicon, polymers, metal, metallic alloys, cellulosic material, or combinations thereof.

Other methods of using the putter 10 and embodiments thereof will become apparent to those skilled in the art in light of the present disclosure. Accordingly, the methods and embodiments pictured and described herein are for illustrative purposes only, and in no way limit the scope of the putter 10 as claimed herein.

It should be noted that the putter 10 is not limited to the specific embodiments pictured and described herein, but is intended to apply to all similar apparatuses and methods for simultaneously picking a ball 12 from a golf cup and cleaning the ball 12. Modifications and alterations from the described embodiments will occur to those skilled in the art without departure from the spirit and scope of the putter 10.

The invention claimed is:

1. A putter comprising:

a. a head, wherein said head comprises:

i. a head ball aperture formed substantially in the center of said head;

ii. a handle housing formed on the top surface of said head, wherein said handle housing includes a handle aperture;

iii. a strike face formed on one side of said head, wherein said strike face is substantially flat and perpendicular with respect to the ground surface during use;

iv. a cavity formed in the bottom surface of said head, wherein said cavity is substantially cylindrical in shape;

v. an interface ring formed in said cavity and extending radially inward, wherein the periphery of said interface ring defines the periphery of said head ball aperture;

b. a cap configured to fit within said cavity in said head, wherein said cap comprises:

i. a cap ball aperture formed in the center of said cap, wherein said cap ball aperture and said head ball aperture are concentric, and wherein said cap is configured to be selectively secured to said head such that said cap may be decoupled from said head;

ii. an insert retainer lip formed in said cap and extending radially inward, wherein the periphery of said insert retainer lip defines the periphery of said cap ball aperture;

c. at least one brush insert, wherein said brush insert is configured to be positioned between said interface ring in said head and said insert retainer lip in said cap, wherein said interface ring, said insert retainer lip, and said brush insert are sized so that a standard golf ball may pass through said interface ring, said brush retainer, and said brush insert; and d. a handle, wherein one end of said handle is configured to engage said handle aperture.

2. A putter comprising:

a. a head, wherein said head comprises:

i. a head ball aperture formed substantially in the center of said head;

ii. a handle housing formed on the top surface of said head, wherein said handle housing includes a handle aperture;

iii. a strike face formed on one side of said head, wherein said strike face is substantially flat and perpendicular with respect to the ground surface during use;

iv. a cavity formed in the bottom surface of said head, wherein said cavity is substantially cylindrical in shape;

v. an interface ring formed in said cavity and extending radially inward, wherein the periphery of said interface ring defines the periphery of said head ball aperture;

b. a cap configured to fit within said cavity in said head, wherein said cap comprises:

i. a cap ball aperture formed in the center of said cap, wherein said cap ball aperture and said head ball aperture are concentric, and wherein said cap is configured to be selectively secured to said head such that said cap may be decoupled from said head;

ii. a cap wall extending axially toward said head;

iii. a bottom contour formed on the bottom surface of said cap, wherein said bottom contour is configured to mimic the curvature of a golf cup;

iv. an insert retainer lip formed in said cap and extending radially inward, wherein the periphery of said insert retainer lip defines the periphery of said cap ball aperture;

c. a brush insert, wherein said brush insert is configured to be positioned within said cap and surrounded on its outer periphery by said cap wall, wherein said brush insert is held between said interface ring and said insert retainer lip, and wherein said interface ring, said insert retainer lip, and said brush insert are sized so that a standard golf ball may pass through said interface ring, said brush retainer, and said brush insert; and d. a handle, wherein one end of said handle is configured to engage said handle aperture.

3. The putter according to claim 2 wherein said brush insert is further defined is including an outer ring and a plurality of brushes extending radially inward from said outer ring.

4. The putter according to claim 3 further comprising a second brush insert, wherein said second brush insert is positioned between said brush insert and said cap.

5. The putter according to claim 4 further comprising a spacer, wherein said spacer is positioned between said two brush inserts.

6. The putter according to claim 5 further comprising a retainer, wherein said retainer is positioned between said second brush insert and said cap.

7. The putter according to claim 6 wherein said head further comprises a head recess formed in the top surface of said head, wherein a plug is configured to fit within a portion of said head recess.

8. The putter according to claim 6 wherein said head and said plug further comprise a plurality of corresponding connector ports, and wherein said cap further comprise a plurality of corresponding connector receivers, wherein said cap and said plug may be secured to said head through engagement of a plurality of fasteners passing through said connector ports and engaging said connector receivers.

9. The putter according to claim 8 wherein said head further comprises a head bottom contour, wherein said head bottom contour is configured to cooperate with said bottom contour of said cap to mimic the curvature of a golf cup.

10. The putter according to claim 9 wherein said handle further comprises:

a. a head engagement portion at a first end of said handle, wherein said head engagement portion is configured to securely engage said handle aperture;

b. a grip at a second end of said handle opposite said head engagement portion; and c. an angle positioned between said head engagement portion and said grip.

11. The putter according to claim 10 wherein said interface ring further comprises an interface ring ridge, wherein said interface ring ridge abuts said first brush insert.

12. The putter according to claim 11 wherein said putter further comprises a plurality of lasers affixed to said head, wherein said lasers are configured to aid the user in aligning a shot.

13. The putter according to claim 12 wherein said recess is further defined as being crescent shaped, wherein the bottom surface of said recess is curved to mimic the curvature of a golf ball.

14. The putter according to claim 13 where said insert retainer lip further comprises an insert retainer ridge.

15. The putter according to claim 14 wherein said head further comprises an alignment port, wherein said cap further comprises a cap alignment port, and wherein an alignment pin is positioned in both said alignment port and said cap alignment port.

16. The putter according to claim 15 wherein said brush insert is further defined as having brushes formed of a nylon material such that said brush insert may be easily and inexpensively replaced.

17. The putter according to claim 2 wherein said putter further comprises a semi-rigid insert, wherein said semi-rigid insert is positioned between said brush insert and said cap.

* * * * *